US010443886B2

(12) United States Patent
Suzuki

(10) Patent No.: US 10,443,886 B2
(45) Date of Patent: Oct. 15, 2019

(54) AIR-CONDITIONING APPARATUS HAVING AN INDICATION APPARATUS

(71) Applicant: Mitsubishi Electric Corporation, Tokyo (JP)

(72) Inventor: Yasuhiro Suzuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 140 days.

(21) Appl. No.: 14/889,492

(22) PCT Filed: Mar. 12, 2014

(86) PCT No.: PCT/JP2014/056540
§ 371 (c)(1),
(2) Date: Nov. 6, 2015

(87) PCT Pub. No.: WO2014/208143
PCT Pub. Date: Dec. 31, 2014

(65) Prior Publication Data

US 2016/0084519 A1 Mar. 24, 2016

(30) Foreign Application Priority Data

Jun. 25, 2013 (JP) ..... 2013-132744

(51) Int. Cl.
*F24F 13/20* (2006.01)
*F24F 13/32* (2006.01)
(Continued)

(52) U.S. Cl.
CPC ..... *F24F 13/20* (2013.01); *F24F 1/0003* (2013.01); *F24F 1/0007* (2013.01); *F24F 11/30* (2018.01);
(Continued)

(58) Field of Classification Search
CPC ..... F24F 13/20; F24F 1/0003; F24F 11/30; F24F 1/0007; F24F 13/32; F24F 11/52;
(Continued)

(56) References Cited

U.S. PATENT DOCUMENTS 4,733,543 A * 3/1988 Blair ..... F24F 1/0003 312/236
5,094,089 A * 3/1992 Lail ..... F24F 1/022 62/262
(Continued)

FOREIGN PATENT DOCUMENTS

CN 201611157 U * 10/2010
JP H06-273007 A 9/1994
(Continued)

OTHER PUBLICATIONS

Panasonic, Installation Instructions Split System Air Conditioner, 2011.*
(Continued)

*Primary Examiner* — Frantz F Jules
*Assistant Examiner* — Nelson J Nieves
(74) *Attorney, Agent, or Firm* — Posz Law Group, PLC

(57) ABSTRACT

An indoor unit of an air-conditioning apparatus includes a housing, an indoor heat exchanger that is disposed in the housing and to which flammable refrigerant is supplied, and an indication section that indicates a minimum distance from a floor surface of the housing when installed on a wall of a room (installation height H0) along with an identifier on a lower surface of the housing.

6 Claims, 5 Drawing Sheets

(51) Int. Cl.

| | |
|---|---|
| ***F24F 1/0003*** | (2019.01) |
| ***F24F 1/0007*** | (2019.01) |
| ***F24F 11/30*** | (2018.01) |
| ***F24B 13/00*** | (2006.01) |
| ***F24F 11/36*** | (2018.01) |
| ***F24F 11/52*** | (2018.01) |
| *F25B 13/00* | (2006.01) |

(52) U.S. Cl.
CPC ..... *F24F 13/32* (2013.01); *F24F 11/36* (2018.01); *F24F 11/52* (2018.01); *F25B 13/00* (2013.01); *F25B 2400/12* (2013.01)

(58) Field of Classification Search
CPC ..... F24F 11/36; F24F 2221/14; F24F 1/0047; F24F 1/64; F25B 2400/12; F25B 13/00
See application file for complete search history.

(56) References Cited

U.S. PATENT DOCUMENTS

| | | | | | |
|---|---|---|---|---|---|
| 5,417,279 | A * | 5/1995 | Wada | F24F 1/0007 | 165/122 |
| 5,564,495 | A * | 10/1996 | Yoshihashi | F24F 1/0007 | 165/122 |
| 6,076,370 | A * | 6/2000 | Da Silva | F24F 1/022 | 454/202 |
| 6,257,012 | B1 * | 7/2001 | Tesche | F04D 29/4226 | 415/204 |
| 6,324,859 | B1 * | 12/2001 | Tesche | F24F 13/20 | 62/262 |
| 6,336,338 | B1 * | 1/2002 | Koren | F24F 1/0003 | 62/262 |
| 6,339,935 | B1 * | 1/2002 | Moretti | F04D 29/4226 | 62/259.1 |
| 6,378,320 | B1 * | 4/2002 | Matambo | F24F 1/22 | 361/807 |
| 2003/0084682 | A1 * | 5/2003 | Choi | F04D 29/4226 | 62/426 |
| 2006/0021359 | A1 * | 2/2006 | Hur | F24F 1/0007 | 62/126 |
| 2006/0201042 | A1 * | 9/2006 | Kim | F24F 1/027 | 40/725 |
| 2007/0044495 | A1 * | 3/2007 | Kim | F24F 1/027 | 62/262 |
| 2007/0170827 | A1 * | 7/2007 | Frenia | F24F 1/0007 | 312/265.5 |
| 2008/0028784 | A1 * | 2/2008 | Takada | F24F 1/0007 | 62/324.6 |
| 2014/0370344 | A1 * | 12/2014 | Lovelace | H01M 2/344 | 429/90 |
| 2015/0121943 | A1 * | 5/2015 | Ishino | F24F 13/20 | 62/426 |

FOREIGN PATENT DOCUMENTS

| | | | | |
|---|---|---|---|---|
| JP | H10-311629 | A | 11/1998 | |
| JP | 2000-213772 | A | 8/2000 | |
| JP | 2000-240970 | A | 9/2000 | |
| JP | 2000240970 | A * | 9/2000 | |
| JP | 2002-372317 | A | 12/2002 | |
| JP | 2012-021690 | A | 2/2012 | |
| JP | 2013-015264 | A | 1/2013 | |
| WO | WO 2013146005 | A1 * | 10/2013 | F24F 13/20 |

OTHER PUBLICATIONS

Energy Star, Innovation. Performance. Savings., 2007.*
ACHPI, R32 for Air Conditioning, 2012.*
Office Action dated Dec. 8, 2015 in the corresponding JP application No. 2015-080126 (with English translation).
Office Action dated Jul. 4, 2016 issued in corresponding CN patent application No. 201410191702.2 (and English translation).
Extended European Search Report dated Jan. 19, 2017 issued in corresponding EP patent application No. 14817586.2.
Office Action dated Feb. 15, 2017 issued in corresponding CN patent application No. 201410191702.2 (and English translation).
Office Action dated Aug. 4, 2015 in the corresponding JP application No. 2015-080126 (with English translation).
International Search Report of the International Searching Authority dated Apr. 28, 2014 for the corresponding international application No. PCT/JP2014/056540 (and English translation).
Office Action dated Aug. 14, 2017 issued in corresponding CN patent application No. 201410191702.2 (and English translation).
Office Action dated Apr. 12, 2019 issued in corresponding IN patent application No. 201647000717 (and English translation).

* cited by examiner

AIR-CONDITIONING APPARATUS HAVING AN INDICATION APPARATUS

CROSS REFERENCE TO RELATED APPLICATION

This application is a U.S. national stage application of International Application No. PCT/JP2014/056540 filed on Mar. 12, 2014, and is based on Japanese Patent Application No. 2013-132744 filed on Jun. 25, 2013, the disclosures of which are incorporated herein by reference.

TECHNICAL FIELD

The present invention relates to an air-conditioning apparatus, and more specifically, an air-conditioning apparatus that is based on a refrigeration cycle that uses refrigerant having a low global warming potential.

BACKGROUND ART

"HFC refrigerant" such as R410A, which is non-flammable, has conventionally been used as refrigerant of a refrigeration cycle for an air-conditioning apparatus. This R410A has zero ozone depleting potential (hereinafter, referred to as "ODP") unlike the conventional "HCFC refrigerant" such as R22, and does not deplete the ozone layer. However, R410A has a high a global warming potential (hereinafter, referred to as "GWP").

Consequently, as one of measures to prevent global warming, replacing HFC refrigerant, having a high GWP, such as R410A with refrigerant having a low GWP has been considered.

As refrigerant having a low GWP to be used, HC refrigerant such as R290 ($C_3H_8$, propane) and R1270 ($C_3H_6$, propylene), which are natural refrigerant, has been suggested. However, unlike R410A, which is non-flammable, HC refrigerant is highly flammable, and thus care should be taken for leakage of the refrigerant.

Further, as refrigerant having a low GWP, for example, R32 ($CH_2F_2$, difluoromethane), which is HFC refrigerant that does not have carbon double bond in its composition and has lower GWP than that of R410A, has been suggested.

Suggestion has also been made for halogenated hydrocarbon, which is a different type of HFC refrigerant than R32 and has carbon double bond in its composition. Such halogenated hydrocarbon may be, for example, HFO-1234yf ($CF_3CF{=}CH_2$, tetrafluoropropene) and HFO-1234ze ($CF_3{-}CH{=}CHF$). The HFC refrigerant that has carbon double bond is often referred to as "HFO" by using "O" for olefin (unsaturated hydrocarbon having carbon double bond is called olefin) to be distinguished from HFC refrigerant such as R32 that does not have carbon double bond in the composition.

Although being not as highly flammable as HC refrigerant such as R290 ($C_3H_8$, propane), which is natural refrigerant, those types of HFC refrigerant (including HFO refrigerant) having a low GWP are mildly flammable unlike R410A, which is non-flammable. Thus, care should also be taken for leakage of the refrigerant as similar to R290. Hereinafter, refrigerant having flammability, even when its level is mild, is referred to as "flammable refrigerant".

To prevent refrigerant concentration in a room from exceeding a specific value in the event of leakage of flammable refrigerant, a refrigerant filling level is stipulated in the international standard (IEC 60335-2-40).

That is, in the international standard, an acceptable level of refrigerant (Mmax) per room is stipulated by an equation "$Mmax=2.5\times(LFL)^{1.25}\times H0\times A^{0.5}$", which is a function of a lower flammability limit (LFL) of refrigerant, a floor area (A), and an installation height of device (H0). The installation height (H0) is defined as "0.6 m" for a floor installation type, "1.8 m" for a wall mounted type, "1.0 m" for a window mounted type, and "2.2 m" for a ceiling mounted type.

To satisfy the above equation, a split type air-conditioning apparatus is disclosed that compares a value of installation floor area stored in the apparatus and an input value of installation floor area for actual installation (after subtracting an installation area of furniture), and gives an instruction to promote ventilation of the room or to collect a portion of refrigerant into a refrigerant storing tank when the input value is smaller than the stored value (when the equation is not satisfied) (for example, see Patent Literature 1).

CITATION LIST

Patent Literature

Patent Literature 1: Japanese Unexamined Patent Application Publication No. 2002-372317 (pages 3-4, FIG. 5)

SUMMARY OF INVENTION

Technical Problem

However, although the split type air-conditioning apparatus disclosed in Patent Literature 1 is configured to receive the input value of the installation floor area from which the installation area of furniture is subtracted, the apparatus does not receive the value of the installation height. That is, attention is not paid to the installation height. Thus, inputting only the value of installation floor area is not enough for an appropriate determination, if the value of actual installation height is smaller (lower) than the stipulated value.

Further, Patent Literature 1 discloses giving an instruction to promote ventilation of the room by inputting the value of installation floor area after subtracting the installation floor area of furniture. However, promoting additional ventilation of the room during air conditioning (cooling or heating) of the room by using the air-conditioning apparatus leads to compromise of comfort and energy-saving performance. That is, comfort and energy-saving performance are compromised since there is no way to confirm the available floor area before installation of the air-conditioning apparatus.

The present invention has been made to solve the above problem, and the first object of the invention is to provide an air-conditioning apparatus configured to reliably instruct a site worker to install the air-conditioning apparatus at a stipulated installation height by having an effortlessly noticeable indication to the site worker that the installation height is stipulated for each indoor unit. The second object of the invention is to provide an air-conditioning apparatus configured to reliably instruct a site worker to install the air-conditioning apparatus in a stipulated floor area by having an effortlessly noticeable indication to the site worker that the available floor area is stipulated on the basis of refrigerant filling level of the air-conditioning apparatus.

Solution to Problem

An air-conditioning apparatus according to the present invention is a split type air-conditioning apparatus including an indoor unit and an outdoor unit. The indoor unit includes a housing, an indoor heat exchanger that is disposed in the housing and to which flammable refrigerant is supplied, and an indication section that is provided on the housing and indicates an installation height for installation in a room as stipulated in an international standard.

Further, the indoor unit includes a housing, an indoor heat exchanger that is disposed in the housing and to which flammable refrigerant is supplied, and an indication section that is provided on the housing and indicates a floor area for installation in a room as stipulated in an international standard.

Advantageous Effects of Invention

According to the present invention, the indication section that indicates "the installation height for installation in a room (or a minimum distance from the floor surface to the housing)" as stipulated in the international standard is provided on the housing. Because the indication section catches attention of (is noticed by) a site worker during installation of the air-conditioning apparatus, the site worker recognizes the installation height necessary for the indoor unit (a minimum distance from the floor surface) and can install the air-conditioning apparatus at the stipulated installation height.

Further, the indication section that indicates "the available floor area on the basis of the refrigerant filling level" as stipulated in the international standard is disposed on the housing. Because the indication section catches attention of (is noticed by) a site worker during installation of the air-conditioning apparatus, the site worker recognizes the floor area (minimum floor area) available for the air-conditioning apparatus and can install the air-conditioning apparatus in the room having the stipulated floor area.

DESCRIPTION OF EMBODIMENTS

Embodiment 1: Wall Mounted Type

Figure 1:
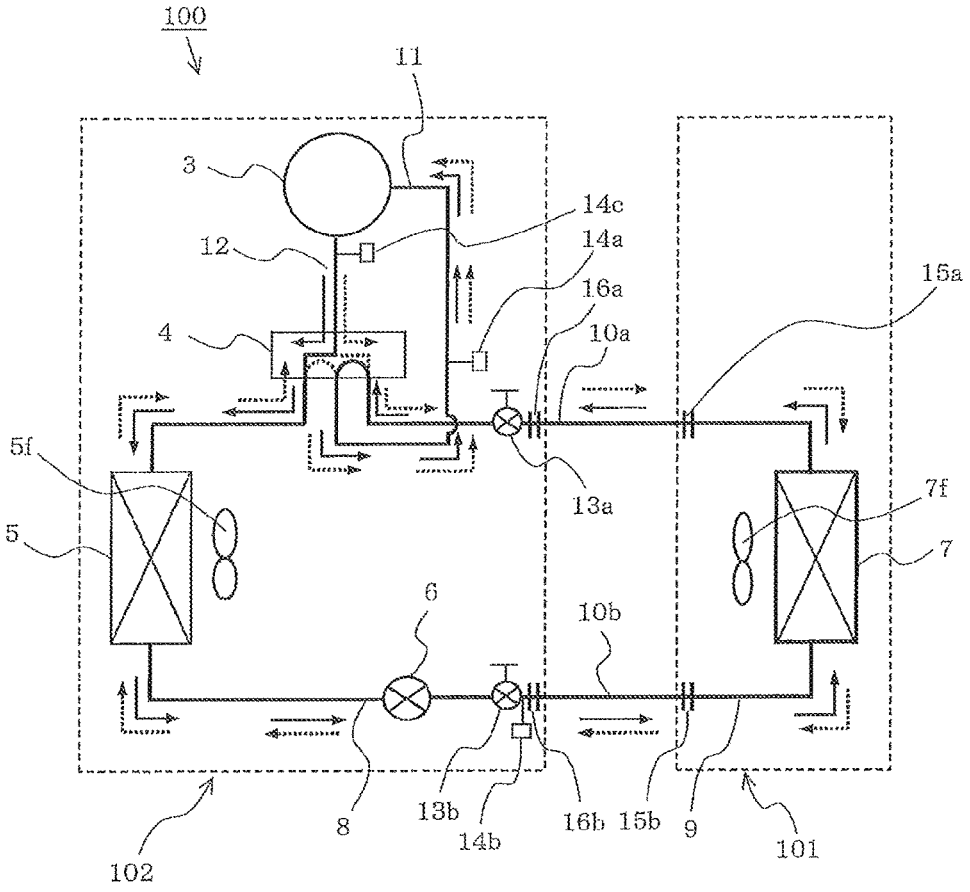
FIG. 1 explains an air-conditioning apparatus according to Embodiment 1 of the present invention and is a refrigerant circuit diagram that schematically shows a configuration of a refrigerant circuit.
Figure 2:
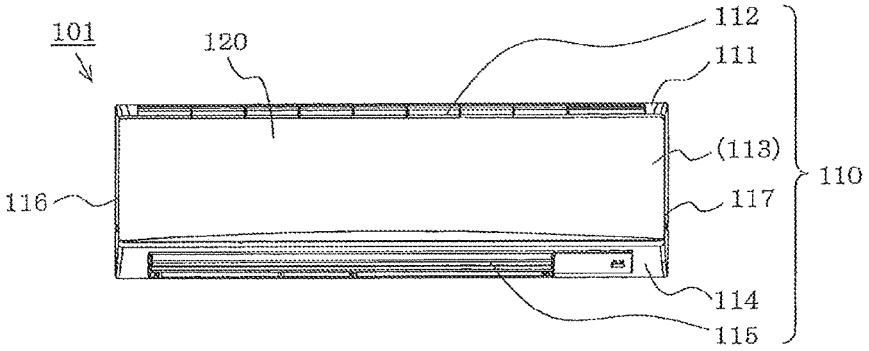
FIG. 2 explains the air-conditioning apparatus according to Embodiment 1 of the present invention and is a front view that shows an outer appearance of an indoor unit.
Figure 3:
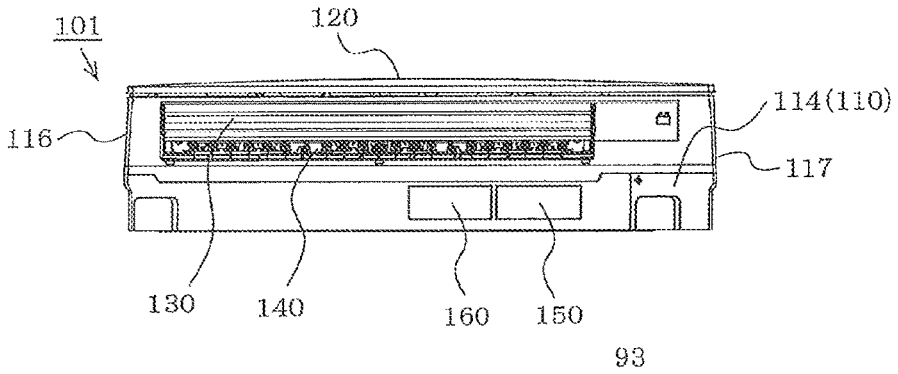
FIG. 3 explains the air-conditioning apparatus according to Embodiment 1 of the present invention and is a bottom view that shows an outer appearance of the indoor unit.
Figure 4:
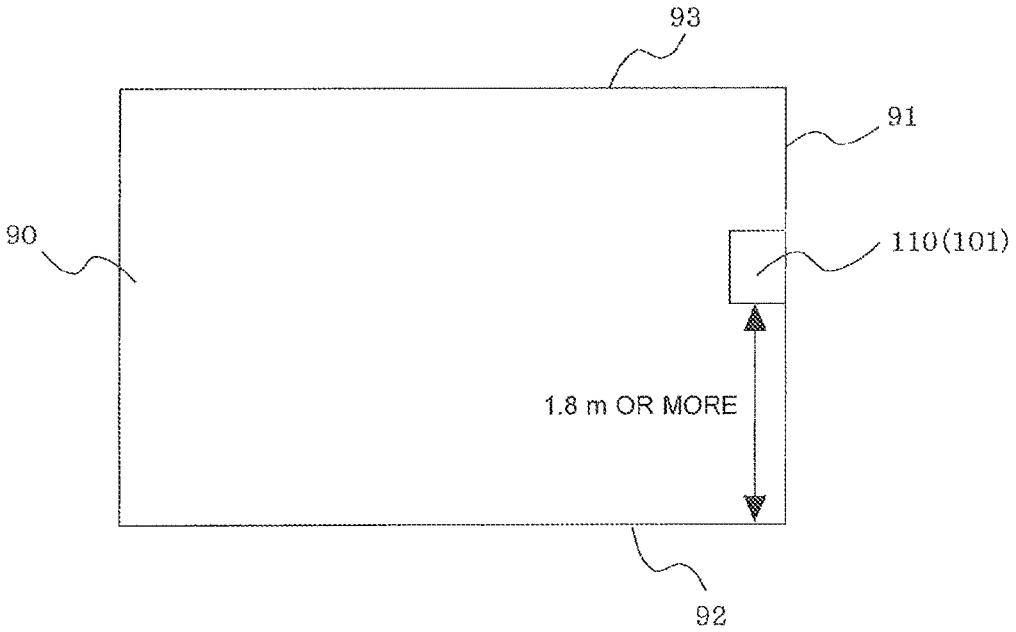
FIG. 4 explains the air-conditioning apparatus according to Embodiment 1 of the present invention and is a side view that shows an installation state of the indoor unit.
Figure 5:
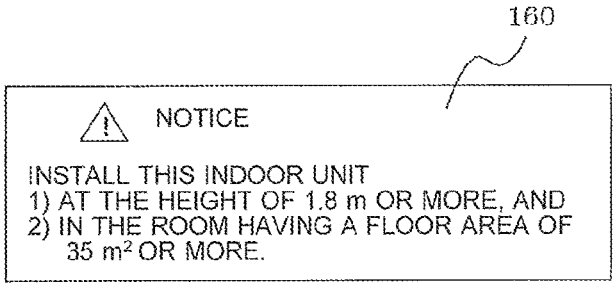
FIG. 5 is a bottom view that shows a part (indication section) of the air-conditioning apparatus according to Embodiment 1 of the present invention.
Figure 6:
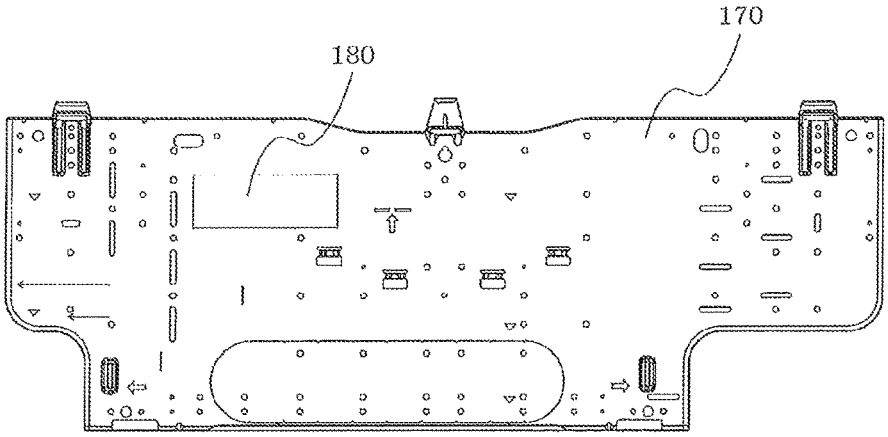
FIG. 6 explains the air-conditioning apparatus according to Embodiment 1 of the present invention and is a front view that shows a part (installation board) of the air-conditioning apparatus.
Figure 7:
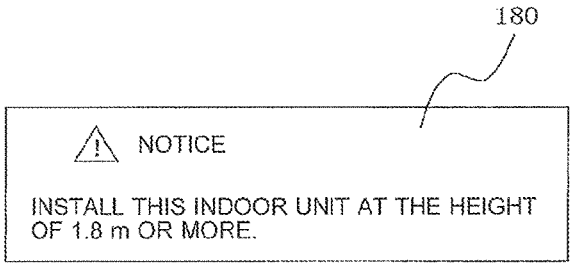
FIG. 7 explains the air-conditioning apparatus according to Embodiment 1 of the present invention and is a front view that shows a part (indication section) of the air-conditioning apparatus.

FIGS. 1 to 7 explain an air-conditioning apparatus according to Embodiment 1 of the present invention. FIG. 1 is a refrigerant circuit diagram that schematically shows a configuration of a refrigerant circuit, FIG. 2 is a front view that shows an outer appearance of an indoor unit, FIG. 3 is a bottom view that shows an outer appearance of the indoor unit, FIG. 4 is a side view that shows an installation state of the indoor unit, FIG. 5 is a bottom view that shows a part (indication section) of the air-conditioning apparatus, FIG. 6 is a front view that shows a part (installation board) of the air-conditioning apparatus, and FIG. 7 is a front view that shows a part (indication section) of the air-conditioning apparatus. The drawings are schematically illustrated and the present invention is not limited to embodiments shown in the drawings.

In FIG. 1, an air-conditioning apparatus 100 is a split type apparatus including an indoor unit (also referred to as "load side unit") 101 disposed on a wall 91 (see FIG. 4) of a room 90, an outdoor unit (also referred to as "heat source side unit") 102 disposed outside the room (not shown in the figure), and extension pipes 10*a* and 10*b*, which connect the indoor unit 101 and the outdoor unit 102.

(Refrigerant Circuit of Outdoor Unit)

The outdoor unit 102 is provided with a compressor 3 that compresses and discharges refrigerant, a refrigerant flow switching valve (hereinafter, referred to as "four-way valve") 4 that switches a flow direction of the refrigerant for a cooling operation and a flow direction of the refrigerant for a heating operation in a refrigerant circuit, an outdoor heat exchanger 5 that is a heat source side heat exchanger that exchanges heat between outside air and refrigerant, and a decompression device (hereinafter, referred to as "expansion valve") 6 that is an expansion unit such as an electronic controlled expansion valve that is capable of changing an opening degree and decompresses refrigerant from high pressure to low pressure, and they are connected to each other by an outdoor refrigerant pipe (also referred to as "heat source side refrigerant pipe") 8.

Further, an outdoor air-sending device 5*f* that supplies (blows) outside air to the outdoor heat exchanger 5 is disposed to face the outdoor heat exchanger 5. When the outdoor air-sending device 5*f* rotates, an air flow that passes through the outdoor heat exchanger 5 is generated. In the outdoor unit 102, a propeller fan is used as the outdoor air-sending device 5*f* and is disposed downstream of the outdoor heat exchanger 5 (downstream of the air flow generated by the outdoor air-sending device 5*f*) to suck the outside air passing through the outdoor heat exchanger 5.

(Outdoor Refrigerant Pipe)

The outdoor refrigerant pipe 8 collectively refers to a refrigerant pipe that connects a gas-side extension pipe connecting valve 13*a* (during cooling operation) and a four-way valve 4, a suction pipe 11, a discharge pipe 12, a refrigerant pipe that connects the four-way valve 4 and the outdoor heat exchanger 5, a refrigerant pipe that connects the outdoor heat exchanger 5 and the expansion valve 6, a refrigerant pipe that connects the expansion valve 6 and a liquid-side extension pipe connecting valve 13*b* (during cooling operation).

(Extension Pipe Connecting Valve)

The outdoor refrigerant pipe 8 has the gas-side extension pipe connecting valve 13*a* at a connecting section to the gas-side extension pipe 10*a*, and the liquid-side extension pipe connecting valve 13*b* at a connecting section to the liquid-side extension pipe 10*b*.

The gas-side extension pipe connecting valve 13*a* is a two-way valve that is capable of switching between opening and closing, and is connected to a flare joint 16*a* at one end.

Further, the liquid-side extension pipe connecting valve 13*b* is a three-way valve that is capable of switching between opening and closing, and is connected to a service port 14*b*, which is used during air purge (in a pre-work for refrigerant supply to the air-conditioning apparatus 100), and a flare joint 16*b*.

Further, the flare joints 16*a* and 16*b* mounted on the extension pipe connecting valves 13*a* and 13*b* (including the service port 14*b*) are externally threaded on the side adjacent to the outdoor refrigerant pipe 8. In shipping of the outdoor unit 102 (including shipping of the air-conditioning apparatus 100), a flare nut (not shown in the figure) that is internally threaded to mate with the external thread is mounted on the external thread.

(Service Port)

For convenience of explanation, a portion of the outdoor refrigerant pipe 8 that extends on a discharge side of the compressor 3 from the compressor 3 to the four-way valve 4 is referred to as the discharge pipe 12, while a portion that extends on a suction side of the compressor 3 from the four-way valve 4 to the compressor 3 is referred to as the suction pipe 11.

Consequently, during both cooling operation (an operation for supplying low temperature and low pressure refrigerant to an indoor heat exchanger 7) and heating operation (an operation for supplying high temperature and high pressure refrigerant to the indoor heat exchanger 7), the high temperature and high pressure gas refrigerant compressed by the compressor 3 constantly flows into the discharge pipe 12 and the low temperature and low pressure refrigerant after evaporation flows in the suction pipe 11.

The low temperature and low pressure refrigerant that flows in the suction pipe 11 may be gas refrigerant or two-phase refrigerant. The suction pipe 11 is provided with the low pressure side service port 14*a* having a flare joint, and the discharge pipe 12 is provided with the high pressure side service port 14*c* having a flare joint, which are connected to a pressure gauge to measure an operation pressure during a trial operation in installation or repair service.

Further, the flare joints of the service ports 14*a* and 14*c* (not shown in the figure) are externally threaded, and in shipping of the outdoor unit 102 (including shipping of the air-conditioning apparatus 100), a flare nut (not shown in the figure) is mounted on the external thread.

(Refrigerant Circuit of Indoor Unit)

The indoor unit 101 is provided with the indoor heat exchanger 7, which is a use side heat exchanger that exchanges heat between indoor air and refrigerant, and the indoor heat exchanger 7 is connected to the indoor refrigerant pipe (also referred to as "use side refrigerant pipe") 9.

Further, the indoor refrigerant pipe 9 has a flare joint 15*a* for connecting the gas-side extension pipe 10*a* at a connecting section to the gas-side extension pipe 10*a*, and a flare joint 15*b* for connecting the liquid-side extension pipe 10*b* at a connecting section to the liquid-side extension pipe 10*b*.

The flare joints 15*a* and 15*b* are externally threaded, and in shipping of the indoor unit 101 (including shipping of the air-conditioning apparatus 100), a flare nut (not shown in the figure) that is internally threaded to mate with the external thread is mounted on the external thread.

Further, an indoor air-sending device 7*f* is disposed to face the indoor heat exchanger 7, and when the indoor air-sending device 7*f* rotates, an air flow that passes through the indoor heat exchanger 7 is generated. The indoor air-sending device 7*f* may be of any type such as that uses cross flow fan or turbo fan depending on the form of the indoor unit 101. In addition, the indoor air-sending device 7*f* may be disposed at a position downstream or upstream of the indoor heat exchanger 7 in the air flow generated by the indoor air-sending device 7*f*.

(Refrigerant Circuit of Air-Conditioning Apparatus)

Each end of the gas-side extension pipe 10*a* is detachably connected to the flare joint 16*a* mounted on the gas-side extension pipe connecting valve 13*a* of the outdoor unit 102 and the flare joint 15*a* mounted on the indoor refrigerant pipe 9 of the indoor unit 101, while each end of the liquid-side extension pipe 10*b* is detachably connected to the flare joint 16*b* mounted on the liquid-side extension pipe connecting valve 13*b* of the outdoor unit 102 and the flare joint 15*b* mounted on the indoor refrigerant pipe 9 of the indoor unit 101.

That is, a refrigerant circuit is formed by the extension pipes 10*a* and 10*b* connecting the outdoor refrigerant pipe 8 and the indoor refrigerant pipe 9 such that a compression type heat pump cycle is provided that circulates the refrigerant compressed by the compressor 3.

(Refrigerant Flow in Cooling Operation)

In FIG. 1, the solid arrow indicates a flow direction of refrigerant in a cooling operation. In a cooling operation, the four-way valve 4 is switched the refrigerant circuit to the one indicated by the solid arrow, and the high temperature and high pressure refrigerant discharged from the compressor 3 first flows into the outdoor heat exchanger 5 via the four-way valve 4.

The outdoor heat exchanger 5 operates as a condenser. That is, when an air flow generated by rotation of the outdoor air-sending device 5*f* passes through the outdoor heat exchanger 5, heat is exchanged between the passing outdoor air and the refrigerant flowing in the outdoor heat exchanger 5, and condensing heat of the refrigerant is applied to the outdoor air. Consequently, the refrigerant is condensed in the outdoor heat exchanger 5 and becomes a liquid refrigerant of high pressure and moderate temperature.

Then, the liquid refrigerant of high pressure and moderate temperature flows into the expansion valve 6 and adiabatically expands in the expansion valve 6 and becomes two-phase refrigerant of low pressure and low temperature.

Then, the two-phase refrigerant of low pressure and low temperature is supplied to the indoor unit 101 via the liquid-side extension pipe 10*b* and flows into the indoor heat exchanger 7. This indoor heat exchanger 7 operates as an evaporator. That is, when a flow of indoor air generated by rotation of the indoor air-sending device 7*f* passes through the indoor heat exchanger 7, heat is exchanged between the passing indoor air and the refrigerant flowing in the indoor heat exchanger 7 and the refrigerant is evaporated while taking an evaporating heat (heating energy) from the indoor air and becomes gas refrigerant or two-phase refrigerant of low temperature and low pressure. On the other hand, the passing indoor air is cooled while taking cooling energy from the refrigerant and cools inside the room.

Further, the gas refrigerant or the two-phase refrigerant of low temperature and low pressure that is evaporated in the indoor heat exchanger 7 is supplied to the outdoor unit 102 via the gas-side extension pipe 10*a* and is sucked into the compressor 3 via the four-way valve 4. Then, the refrigerant is again compressed into high temperature and high pressure gas refrigerant in the compressor 3. During cooling operation, this cycle is repeated.

(Refrigerant Flow in Heating Operation)

In FIG. 1, the dotted arrow indicates a flow direction of refrigerant in a heating operation. When the four-way valve 4 is switched the refrigerant circuit to the one indicated by the dotted arrow, the refrigerant flows in a direction opposite to that in the cooling operation, and first flows into the indoor heat exchanger 7. The indoor heat exchanger 7 operates as a condenser and the outdoor heat exchanger 5 operates as an evaporator. The indoor air is heated by condensing heat (heating energy) when passing through the indoor heat exchanger 7, causing a heating operation.

(Refrigerant)

The air-conditioning apparatus 100 uses, as a refrigerant that flows in the refrigerant circuit, HFC refrigerant R32 ($CH_2F_2$, difluoromethane) having smaller GWP than HFC refrigerant R410A, which is commonly used in air-conditioning apparatuses, and a relatively small effect on global warming and mild inflammability. A specific amount of refrigerant is sealed in the outdoor unit 102 in shipping. If the amount is insufficient for the lengths of the extension pipes 10*a* and 10*b* during installation of the air-conditioning apparatus 100, the refrigerant is additionally supplied by site work.

Further, the refrigerant is not limited to R32, and may be HFO refrigerant having mild inflammability similar to the above described R32, such as HFO-1234yf ($CF_3CF{=}CH_2$, tetrafluoropropene) and HFO-1234ze ($CF_3{-}CH{=}CHF$), which is a type of the above described HFC refrigerant but is a halogenated hydrocarbon having a carbon double bond in its composition, and has smaller GWP than that of R32.

Alternatively, the refrigerant may be HC refrigerant having high inflammability such as R290 ($C_3H_8$, propane) and R1270 ($C_3H_6$, propylene). Further, the refrigerant may be a mixed refrigerant that is a mixture of two or more of these refrigerant.

(Outer Appearance of Indoor Unit)

In FIG. 2 to (c), the indoor unit 101 includes a housing 110 that includes an air inlet 112 formed on an upper surface 111 and an air outlet 115 formed to extend across a front surface 113 and a lower surface 114, a decorative panel 120, which is detachably mounted on the front surface 113 of the housing 110, a vertical air deflector 130 that is disposed at the air outlet 115 and adjusts a vertical direction of a blowing direction of air conditioned by the indoor heat exchanger 7 (see FIG. 1) (hereinafter, referred to as "conditioned air"), and a horizontal air deflector 140 that is disposed more inside the housing 110 (upstream side) than the air outlet 115 and adjusts a horizontal direction of the blowing direction. Further, an identifier 150 and an indication section 160 are provided on the lower surface 114.

The housing 110 is installed on the wall 91 of the room 90, and the lower surface 114 is at a position higher than 1.8 m, which is an installation height (H0), from a floor surface 92.

(Identifier)

The identifier 150 has a description of the model and manufacturer of the air-conditioning apparatus 100, the name of used refrigerant and other information.

The present invention is not intended to be limited to the content of indication on the identifier 150 (such as characters and symbols) and the form of indication (such as embossing and debossing the lower surface 114, printing on the lower surface 114, and attaching a plate having a description of content).

(Indication Section)

In FIG. 5, the indication section 160 has a description "INSTALL THIS INDOOR UNIT 1) AT THE HEIGHT OF 1.8 M OR MORE, AND 2) IN THE ROOM HAVING A FLOOR AREA OF 35 $M^2$ OR MORE." That is, "the value of installation height (H0)" and "the floor area" that corresponds to the refrigerant filling level of the air-conditioning apparatus 100 in the equation described below, which is stipulated in the international standard (IEC 60335-2-40) for a wall mounted type indoor unit to be mounted on a wall of a room, are described.

The form of the indication section 160 is not specifically limited, and description of content may be indicated by directly embossing and debossing the lower surface 114 or by coloring (printing) the lower surface 114. Alternatively, a strip or piece (plate) having the description of content by embossing and debossing or coloring may be permanently attached or may be attached to be removable after the installation of the housing 110.

Although the indication section 160 in the above description is provided on the lower surface 114, the present invention is not limited thereto. Alternatively, the indication section 160 may be provided on the side surface 116 or the side surface 117.

Further, the indication section 160 may indicate only "the value of installation height (H0)" or only "the value of minimum flow area".

(International Standard)

The international standard defines an acceptable level of refrigerant (Mmax) per a room by an equation "$Mmax=2.5=(LFL)^{1.25}\times H0\times A^{0.5}$", where "LFL" is a lower flammability limit of refrigerant, "A" is a floor area of the floor surface 92, and "H0" is a minimum distance (also referred to as "installation height") between the lower surface 114 and the floor surface 92. The installation height (H0) is defined as "0.6 m" for a floor installation type, "1.8 m" for a wall mounted type, "1.0 m" for a window mounted type, and "2.2 m" for a ceiling mounted type.

(Advantageous Effect)

When the indoor unit 101 of the air-conditioning apparatus 100 is installed on the wall 91, since the indication section 160 catches attention of (is noticed by) a site worker (not shown in the figure), the site worker recognizes the installation height necessary for the indoor unit 101 (a minimum distance between the lower surface 114 of the housing 110 and the floor surface 92) and can install the indoor unit 101 (housing 110) at the stipulated installation height.

That is, since the indoor unit 101 can be prevented from being inadvertently installed at a low position, thereby preventing dissatisfying the international standard.

Further, the indication section 160 that indicates "the available floor area on the basis of the refrigerant filling level" as stipulated in the international standard is disposed on the housing 110. Since the indication section 160 catches attention of (is noticed by) a site worker during installation of the air-conditioning apparatus 100, the site worker recognizes the floor area (minimum floor area) available for the air-conditioning apparatus 100 and can install the air-conditioning apparatus 100 in the room having the stipulated floor area. That is, since the air-conditioning apparatus 100 can be prevented from being inadvertently installed in a room having a small floor area (small room), thereby preventing dissatisfying the international standard. This eliminates a need of performing additional venting, thereby preventing compromising comfort and energy reduction.

(Installation Board)

In FIG. 6, an installation board 170 is directly mounted on the wall 91, and the indoor unit 101 is mounted on the installation board 170. That is, the indoor unit 101 is not directly installed on the wall 91 but indirectly mounted via the installation board 170. In this case, an indication section 180 is provided on the installation board 170.

In FIG. 7, the indication section 180 has a description "INSTALL THIS INDOOR UNIT AT THE HEIGHT OF 1.8 M OR MORE." However, a description regarding a floor area may be added similar to the indication section 160.

Consequently, when the indoor unit 101 is installed on the wall 91, the installation board 170 is disposed on the wall 91 in advance, and the indication section 180 is disposed on the installation board 170. Since the indication section 180 catches attention of (is noticed by) a site worker (not shown in the figure), the site worker recognizes the installation height necessary for the indoor unit 101 (a minimum distance between the lower surface 114 of the housing 110 and the floor surface 92) and can install the installation board 170 at the stipulated installation height and install the indoor unit 101 (housing 110) at the stipulated installation height via the installation board 170.

Embodiment 2: Ceiling Mounted Type

Figure 8:
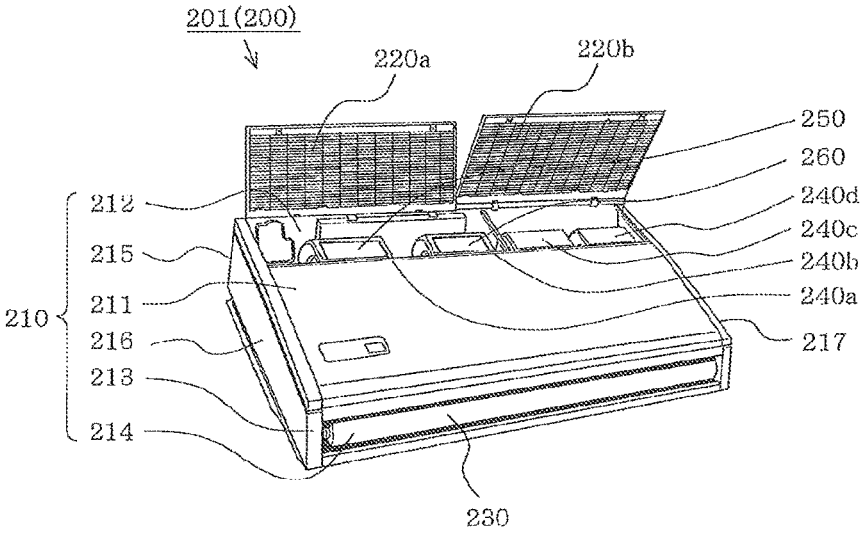
FIG. 8 explains the air-conditioning apparatus according to Embodiment 2 of the present invention and is a perspective view that shows an outer appearance of the indoor unit.
Figure 9:
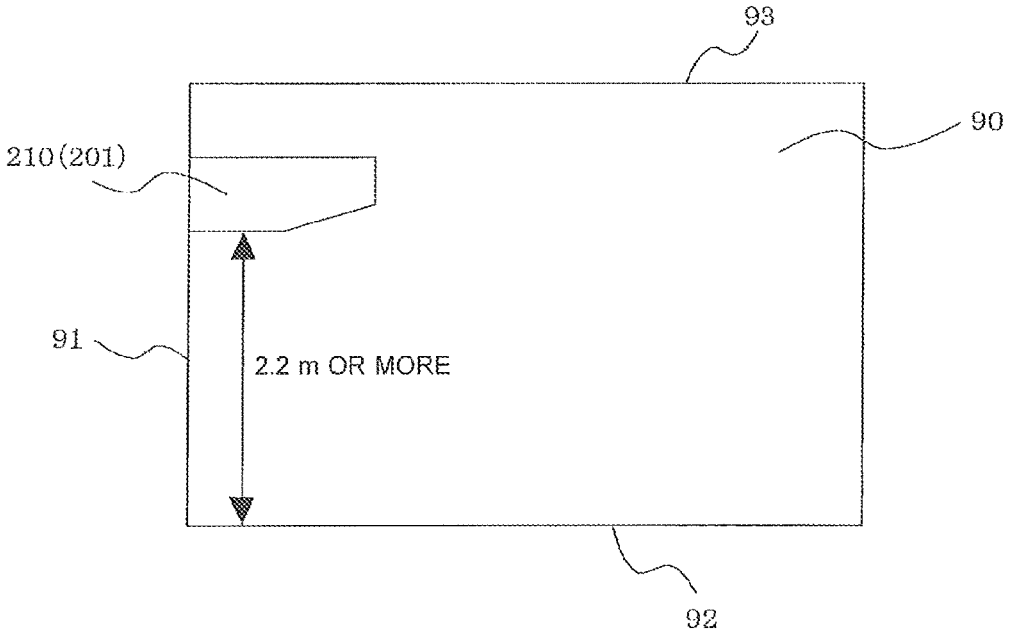
FIG. 9 explains the air-conditioning apparatus according to Embodiment 2 of the present invention and is a side view that shows an installation state of the indoor unit.
Figure 10:
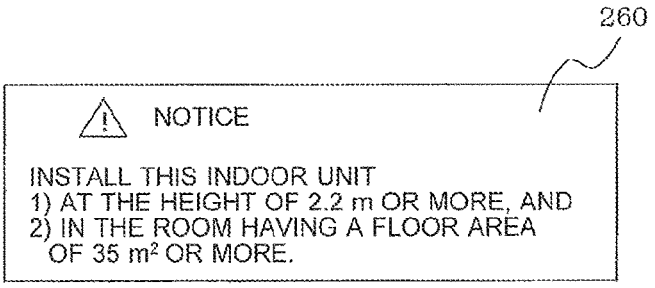
FIG. 10 is a bottom view that shows a part (indication section) of the air-conditioning apparatus according to Embodiment 2 of the present invention.

FIGS. 8 to 10 explain the air-conditioning apparatus according to Embodiment 2 of the present invention. FIG. 8 is a perspective view that shows an outer appearance of the indoor unit, FIG. 9 is a side view that shows an installation state of the indoor unit, and FIG. 10 is a bottom view that shows a part (indication section) of the air-conditioning apparatus. The drawings are schematically illustrated and the present invention is not limited to embodiments shown in the drawings. Further, components that are the same or correspond to those of Embodiment 1 are denoted by the same reference signs, and a part of the description is omitted.

In FIGS. 8 and 9, the air-conditioning apparatus 200 (not shown in the figure) that has an indoor unit 201 according to Embodiment 2 is a split type apparatus including an indoor unit (also referred to as "load side unit") 201 hung from a ceiling 93 of the room 90, an outdoor unit (not shown in the figure) disposed outside the room (not shown in the figure), and extension pipes (not shown in the figure) that connect the indoor unit 201 and the outdoor unit.

Further, devices for performing a refrigeration cycle of the air-conditioning apparatus 200 and a configuration of the refrigerant circuit, and a flowing method of refrigerant are the same as those of the air-conditioning apparatus 100 (Embodiment 1) and the description thereof is omitted.

(Indoor Unit)

In FIGS. 8 and 9, the indoor unit 201 includes a housing 210 that includes an air inlet 212 formed on a lower surface 211 at a position close to a rear surface 215 and an air outlet 214 formed on a front surface 213, air inlet covers 220*a* and 220*b* that openably cover the air inlet 212 and has a plurality of slits for gaps through which air flows freely, and a vertical air deflector 230 that is disposed at the air outlet 214 and adjusts a vertical direction of a blowing direction of conditioned air.

Further, the indoor air-sending device 7*f*, which is not shown in the figure, is covered by casings 240*a*, 240*b*, 240*c*, and 240*d*. The casings 240*a*, 240*b*, 240*c*, and 240*d* are disposed in the air inlet 212 in the range of positions that face the air inlet covers 220*a* and 220*b* when the air inlet 212 is closed and are capable of being visually observed from the outside of the indoor unit 201 when the air inlet covers 220*a* and 220*b* open the air inlet 212.

Further, an identifier 250 and an indication section 260 are provided on the lower surface of the casing 240*a* and the lower surface of the casing 240*b* in the range that faces the air inlet 212.

In FIG. 8, the casing 240*a* and the other casings are provided in four rows, and the identifier 250 is disposed in the row of the end side and the indication section 260 is disposed in the row of the center side so that the identifier 250 and the indication section 260 are aligned. However, the present invention is not limited thereto, and the identifier 250 and the indication section 260 may be disposed in any row, the identifier 250 and the indication section 260 may be disposed in the same row, and the number of rows is not limited to four.

(Indication Section)

In FIG. 10, the indication section 260 has a description "INSTALL THIS INDOOR UNIT 1) AT THE HEIGHT OF 2.2 M OR MORE, AND 2) IN THE ROOM HAVING A FLOOR AREA OF 35 $M^2$ OR MORE." That is, "the value of installation height (H0)" for the ceiling mounted type, which is "2.2 m," and "the floor area" that corresponds to the refrigerant filling level of the air-conditioning apparatus 200 in the above equation of the international standard (IEC 60335-2-40), which is stipulated for a wall mounted type indoor unit to be installed on the wall of the room, are described.

The form of the indication section 260 is similar to that of the indication section 160. Although the indication section 260 is provided on the lower surface of the casing 240*a*, the present invention is not limited thereto. Alternatively, the indication section 260 may be provided on a side surface 216, a side surface 217, or the lower surface 211 of the housing 210.

(Advantageous Effect)

When the indoor unit 201 of the air-conditioning apparatus 200 is hung from the ceiling 93, a site worker (not shown in the figure) opens the air inlet covers 220*a* and 220*b* and the indication section 260 is visually exposed from the outside through the air inlet 212. Since the indication section 260 catches attention of (is noticed by) a site worker (not shown in the figure), the site worker recognizes the installation height necessary for the indoor unit 201 (a minimum distance between the lower surface 211 of the housing 210 and the floor surface 92) and can install the indoor unit 201 (housing 210) at the stipulated installation height.

That is, since the indoor unit 201 can be prevented from being inadvertently installed at a low position, thereby preventing dissatisfying the international standard.

Further, the indication section 260 that indicates "the available floor area on the basis of the refrigerant filling level" as stipulated in the international standard is disposed on the housing 210. Consequently, the air-conditioning apparatus 200 can be prevented from being inadvertently installed in a room having a small floor area (small room) similar to Embodiment 1, thereby preventing dissatisfying the international standard and also preventing compromising comfort and energy reduction.

Embodiment 3: Ceiling Embedded Type

Figure 11:
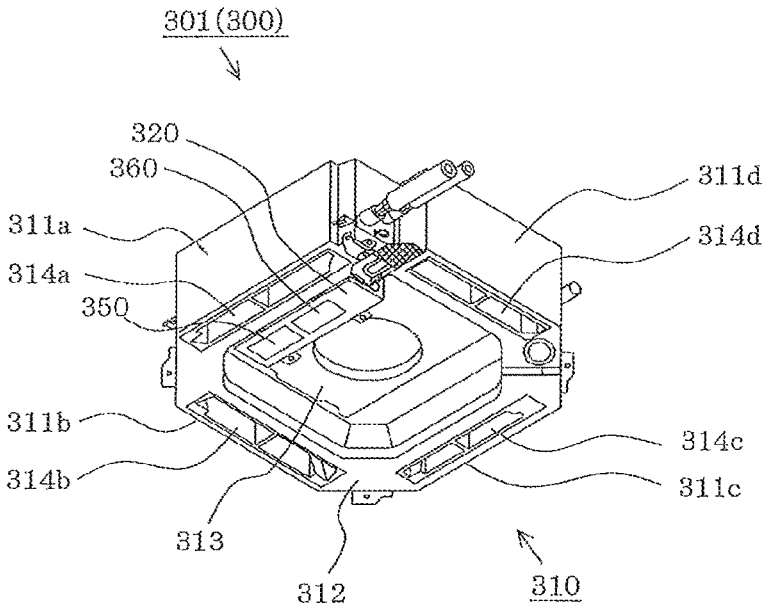
FIG. 11 explains the air-conditioning apparatus according to Embodiment 3 of the present invention and is a perspective view that shows an outer appearance of the indoor unit.
Figure 12:
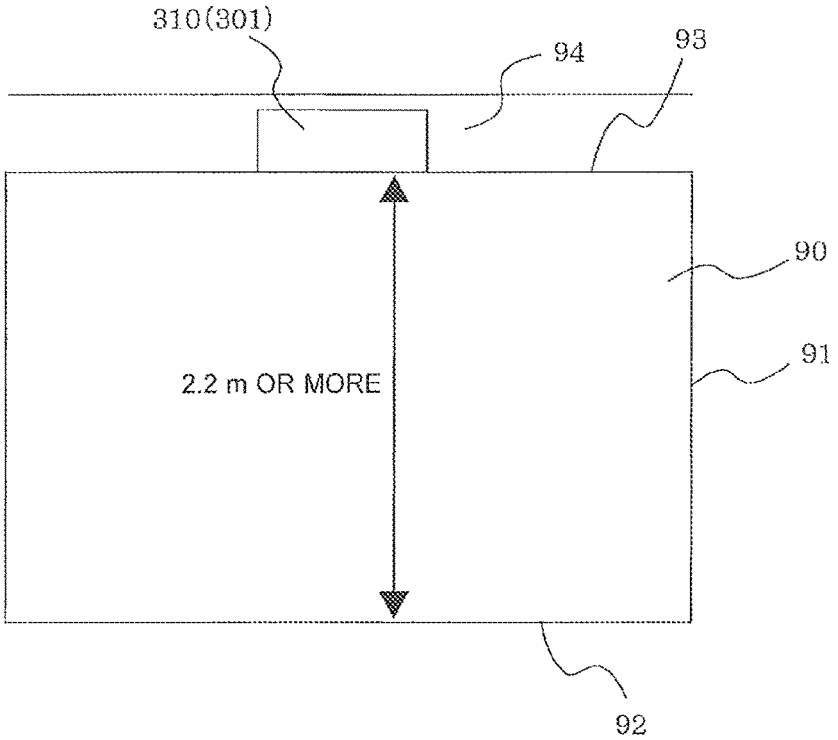
FIG. 12 explains the air-conditioning apparatus according to Embodiment 3 of the present invention and is a side view that shows an installation state of the indoor unit.

FIGS. 11 and 12 explain the air-conditioning apparatus according to Embodiment 3 of the present invention. FIG. 11 is a perspective view that shows an outer appearance of the indoor unit, and FIG. 12 is a side view that shows an installation state of the indoor unit.

The drawings are schematically illustrated and the present invention is not limited to embodiments shown in the drawings. Further, components that are the same or correspond to those of Embodiment 1 are denoted by the same reference signs, and a part of the description is omitted.

In FIGS. 11 and 12, the air-conditioning apparatus 300 (not shown in the figure) that has an indoor unit 301 according to Embodiment 3 is a split type apparatus including an indoor unit (also referred to as "load side unit") 301 embedded in a ceiling space (embedding area) 94 formed above the ceiling 93 of the room 90, an outdoor unit (not shown in the figure) disposed outside the room (not shown in the figure), and extension pipes (not shown in the figure) that connect the indoor unit 301 and the outdoor unit.

Further, devices for performing a refrigeration cycle of the air-conditioning apparatus 300 and a configuration of the refrigerant circuit, and a flowing method of refrigerant are the same as those of the air-conditioning apparatus 100 (Embodiment 1) and the description thereof is omitted.

(Indoor Unit)

In FIGS. 11 and 12, the indoor unit 301 includes a quadrangular prism shape housing 310 having side surfaces 311*a*, 311*b*, 311*c*, and 311*d*, an air inlet 313 is formed by an opening in the center area of a lower surface 312 of the housing 310, and air outlets 314*a*, 314*b*, 314*c*, and 314*d* are formed along the side surfaces 311*a*, 311*b*, 311*c*, and 311*d*, respectively.

An indoor air-sending device 7*f* (see FIG. 1, not shown in the figure) is disposed to face the air inlet 313 at the center of the housing 310, and the indoor heat exchanger 7 is disposed surrounding the indoor air-sending device 7*f*.

Further, an electronics box 320 is disposed in the air inlet 313 of an air outlet 314*a* (on the opposite side of the side surface 311*a*), an identifier 350 and an indication section 360 are disposed on the lower surface of the electronics box 320.

The lower surface 312 of the housing 310 is covered by a decorative panel (not shown in the figure) that is detachably mounted. When the indoor unit 301 is installed in the ceiling space 94, the decorative panel is mounted after installation of the indoor unit 301 as shown in FIGS. 11 and 12 (part of illustration is omitted). That is, when the indoor unit 301 is installed in the ceiling space 94, the identifier 350 and the indication section 360 are exposed to be seen by a site worker.

(Indication Section)

Similar to the indication section 260, the indication section 360 has a description "INSTALL THIS INDOOR UNIT AT THE HEIGHT OF 2.2 M OR MORE (see FIG. 10)." That is, "the value of installation height (H0)" for the ceiling mounted type, which is "2.2 m," in the above equation of the international standard (IEC 60335-2-40), which is stipulated for a wall mounted type indoor unit to be installed on the wall of the room, is described.

The form of the indication section 360 is similar to that of the indication section 160.

Although the identifier 350 and the indication section 360 are disposed on the electronics box 320 in FIG. 11, the present invention is not limited thereto. Alternatively, one or both of the identifier 350 and the indication section 360 may be disposed on the lower surface 312 (for example, between the air outlet 314*b* and the air outlet 314*c*).

(Advantageous Effect)

When the indoor unit 301 of the air-conditioning apparatus 300 is installed in the ceiling space 94 of the ceiling 93, the lower surface of the electronics box 320 is visually exposed from the outside (the indication section 360 is disposed on the lower surface). Since the indication section 360 catches attention of (is noticed by) a site worker (not shown in the figure), the site worker recognizes the installation height necessary for the indoor unit 301 (a minimum distance between the lower surface 312 of the housing 310 and the floor surface 92) and can install the indoor unit 301 (housing 310) at the stipulated installation height.

That is, since the indoor unit 301 can be prevented from being inadvertently installed at a low position, thereby preventing dissatisfying the international standard.

Further, the indication section 360 that indicates "the available floor area on the basis of the refrigerant filling level" as stipulated in the international standard is disposed on the housing 310. Consequently, the air-conditioning apparatus 300 can be prevented from being inadvertently installed in a room having a small floor area (small room) similar to Embodiments 1 and 2, thereby preventing dissatisfying the international standard and also preventing compromising comfort and energy reduction.

REFERENCE SIGNS LIST

3 compressor 4 four-way valve 5 outdoor heat exchanger 5*f* outdoor air-sending device 6 expansion valve 7 indoor heat exchanger

7*f* indoor air-sending device 8 outdoor refrigerant pipe 9 indoor refrigerant pipe 10*a* extension pipe 10*b* extension pipe 11 suction pipe 12 discharge pipe 13*a* extension pipe connecting valve 13*b* extension pipe connecting valve 14*a* service port 14*b* service port 14*c* service port 15*a* flare joint 15*b* flare joint 16*a* flare joint 16*b* flare joint

90 room 91 wall 92 floor surface 93 ceiling 94 ceiling space

100 air-conditioning apparatus (Embodiment 1) 101 indoor unit 102 outdoor unit 110 housing 111 upper surface 112 air inlet 113 front surface 114 lower surface 115 air outlet 116 side surface 117 side surface 120 decorative panel 130 vertical air deflector 140 horizontal air deflector 150 identifier 160 indication section 170 installation board 180 indication section 200 air-conditioning apparatus (Embodiment 2) 201 indoor unit 210 housing 211 lower surface

212 air inlet 213 front surface 214 air outlet 215 rear surface

216 side surface 217 side surface 220*a* air inlet cover 220*b* air inlet cover 230 vertical air deflector 240*a* casing 240*b* casing 240*c* casing 240*d* casing 250 identifier 260 indication section 300 air-conditioning apparatus (Embodiment 3) 301 indoor unit (Embodiment 1)

310 housing 311*a* side surface 311*b* side surface 311*c* side surface 311*d* side surface 312 lower surface 313 air inlet

314*a* air outlet 314*b* air outlet 314*c* air outlet 314*d* air outlet

320 electronics box 350 identifier 360 indication section

The invention claimed is:

1. A split type air-conditioning apparatus comprising an indoor unit and an outdoor unit, the indoor unit including:

a housing;

an indoor heat exchanger being disposed in the housing and to which flammable refrigerant is supplied;

a casing being disposed in the housing and covering an air-sending device;

an air inlet formed on a bottom of the housing;

an air inlet cover that openably covers the air inlet; and an indication section indicating one or both of an installation height stipulated for a type of the indoor unit installed in a room, and an available floor area in the room on a basis of the refrigerant filling level of the air-conditioning apparatus, wherein the indoor unit is configured to be mounted on the ceiling, the indication section is provided on the casing at a position that is capable of being visually observed through the air inlet formed on the bottom of the housing from an outside when the air inlet cover is opened.

2. The air-conditioning apparatus of claim 1, wherein the indication section has embossing or debossing indication or printing indication.

3. The air-conditioning apparatus of claim 2, wherein the indication section is permanently attached.

4. The air-conditioning apparatus of claim 1, wherein the refrigerant is R32 ($CH_2F_2$, difluoromethane), which is HFC refrigerant, HFO-1234yf ($CF_3CF{=}CH_2$, tetrafluoropropene), or HFO-1234ze (($CF_3{-}CH{=}CHF$).

5. The air-conditioning apparatus of claim 2, wherein the indication section is removably attached.

6. The air-conditioning apparatus of claim 1, wherein the indoor unit further includes an identifier having a description of at least one of a model of the air-conditioning apparatus and a name of the refrigerant, and wherein the indication section and the identifier are aligned.

* * * * *